US010071578B2

(12) United States Patent
Sing et al.

(10) Patent No.: US 10,071,578 B2
(45) Date of Patent: Sep. 11, 2018

(54) MOUNTING DEVICE

(71) Applicant: HEWLETT-PACKARD DEVELOPMENT COMPANY, L.P., Houston, TX (US)

(72) Inventors: Samrin Sing, Vancouver, WA (US); Jeffrey G Bingham, Vancouver, WA (US); Justin M Roman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/509,538

(22) PCT Filed: Sep. 22, 2014

(86) PCT No.: PCT/US2014/056807

§ 371 (c)(1),
(2) Date: Mar. 8, 2017

(87) PCT Pub. No.: WO2016/048270

PCT Pub. Date: Mar. 31, 2016

(65) Prior Publication Data

US 2017/0282615 A1 Oct. 5, 2017

(51) Int. Cl.
*B41J 2/175* (2006.01)
*B41J 25/34* (2006.01)

(52) U.S. Cl.
CPC ..... *B41J 25/34* (2013.01); *B41J 2/17523* (2013.01)

(58) Field of Classification Search
CPC ..... B41J 2/17523; B41J 2/1752
See application file for complete search history.

(56) References Cited

U.S. PATENT DOCUMENTS 3,795,191 A 3/1974 Thornton et al.
6,003,981 A 12/1999 Cameron et al.
(Continued)

FOREIGN PATENT DOCUMENTS

CN 1600557 3/2005
CN 102085763 6/2011
(Continued)

*Primary Examiner* — Julian Huffman
(74) *Attorney, Agent, or Firm* — HP Inc. Patent Department

(57) ABSTRACT

Examples of a mounting device and method are disclosed herein. An example of the mounting device includes a carriage to hold a printhead assembly and an interconnect assembly to supply printing composition to the printhead assembly. The mounting device also includes a first latching assembly having an engaged condition to lock the interconnect assembly to a manifold of the printhead assembly and a disengaged condition to unlock the interconnect assembly from the manifold of the printhead assembly. The mounting device additionally includes a second latching assembly having an engaged condition to lock the printhead assembly to the carriage and a disengaged condition to unlock the printhead assembly from the carriage. In this example of the mounting device, the second latching assembly cannot be moved from the engaged condition to the disengaged condition unless the fast latching assembly is in the disengaged condition.

15 Claims, 13 Drawing Sheets

(56) References Cited

U.S. PATENT DOCUMENTS

| | | | | |
|---|---|---|---|---|
| 6,030,073 | A * | 2/2000 | Coiner | B41J 2/17509 347/84 |
| 6,386,681 | B1 | 5/2002 | Askren et al. | |
| 6,623,105 | B1 | 9/2003 | Shen | |
| 7,717,549 | B2 | 5/2010 | Rademakers et al. | |
| 7,841,712 | B2 | 11/2010 | Muyskens et al. | |
| 8,403,458 | B2 | 3/2013 | Montfort et al. | |
| 8,425,132 | B2 | 4/2013 | Bouverie et al. | |
| 2004/0001126 | A1* | 1/2004 | Oda | B41J 2/17509 347/85 |
| 2004/0246284 | A1 | 12/2004 | Murai et al. | |
| 2005/0069370 | A1 | 3/2005 | Yamada et al. | |
| 2012/0268534 | A1* | 10/2012 | Gomez | B41J 2/17523 347/86 |
| 2012/0269565 | A1 | 10/2012 | Bradway | |

FOREIGN PATENT DOCUMENTS

| | | |
|---|---|---|
| EP | 0805046 | 4/1997 |
| EP | 0890442 | 1/1999 |
| WO | WO-2005070679 | 1/2004 |

* cited by examiner

MOUNTING DEVICE

BACKGROUND

End users appreciate reliability and performance printing devices. They also appreciate ease of use and cost effective solutions for their printing needs. Designers and manufacturers may, therefore, endeavor to create and provide printing devices directed toward at least some of these objectives.

BRIEF DESCRIPTION OF THE DRAWINGS

The following detailed description references the drawings, wherein.

DETAILED DESCRIPTION

Figure 1:
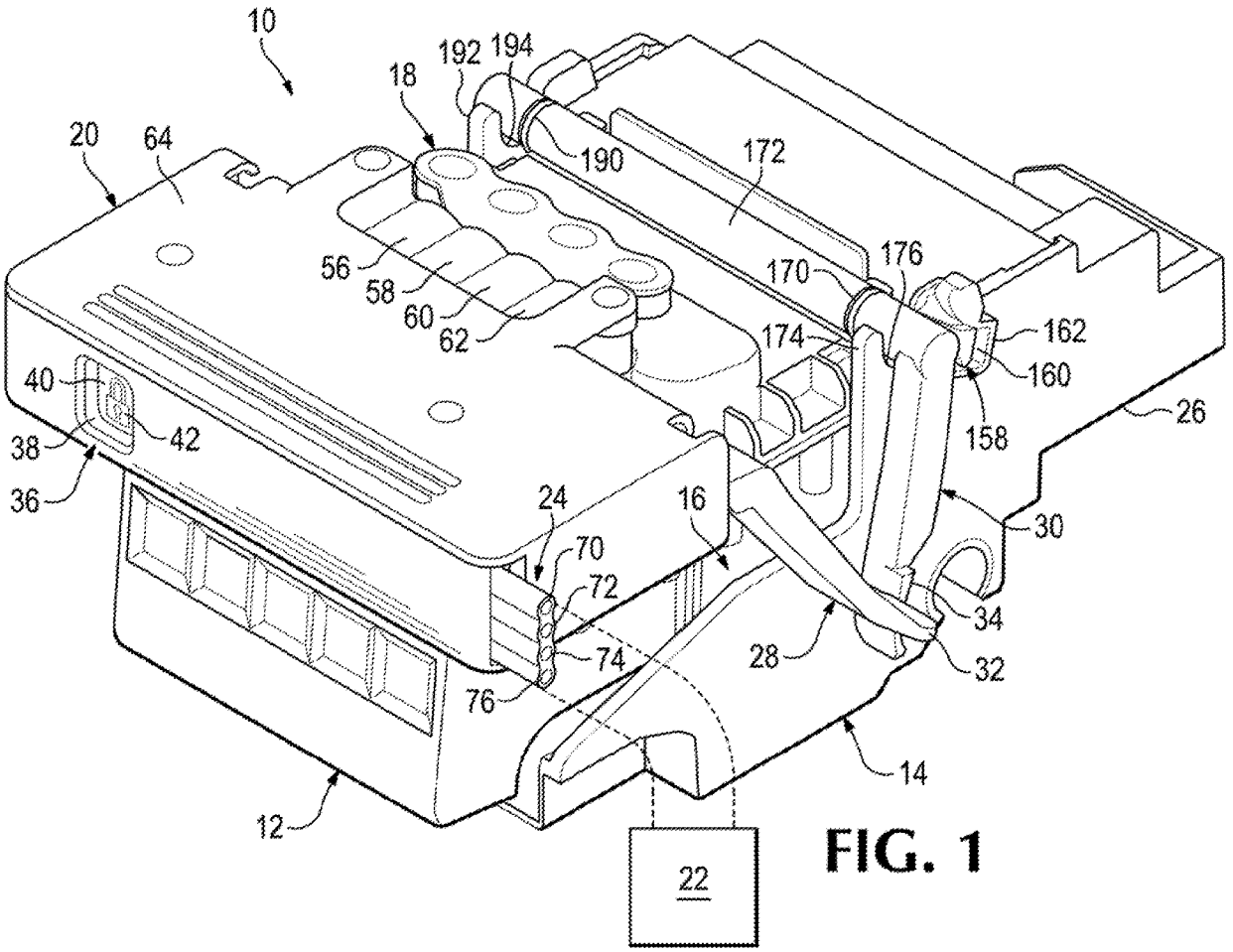
FIG. 1 is an isometric view of an example of a mounting device.

Printing devices may utilize printing composition to create, for example, text and images on media. Some printing devices may utilize as printhead assembly that is mounted or attached to a carriage of the printing device that is specifically designed to hold the printhead assembly.

The printhead assembly may be of a type where all the printing composition that is utilized by the printing device is contained within a printing composition tank of the printhead assembly located on the carriage of the printing device. This type of printhead assembly may be referred to as an "on-axis" design. This type of printhead assembly has several advantages, but may be perceived by some end users in higher utilization environments, such as an office or industrial setting, as limiting due to the fixed amount of printing composition held by the printing composition tank of the printhead assembly. For example, once the printing composition within a tank is depleted, the printhead assembly is replaced which takes end user time and may be perceived as an inconvenience by some end users.

Another type of printhead assembly design may utilize a separate printing composition supply and tube assembly to provide printing composition to the print head assembly. This type of printhead assembly may be referred to as an "off-axis" design. This type of printhead assembly also has several advantages including, for example, increased printing composition capacity which may be appreciated by some end users, such as those in higher utilization environments.

However, this "off-axis" printhead assembly may require a differently designed carriage and/or carriage latching assembly which can add cost to the redesign of a printing device originally constructed to utilize an "on-axis" printhead assembly design. Such cost increase may need to be incorporated into the price that end-users have to pay for such a redesigned printing device that utilizes an "off-axis" printhead assembly. This increased price may result in reduced sales of such a redesigned printing device.

Examples directed to utilizing a separate printing composition supply and tube assembly to provide printing composition to a printhead assembly originally designed to be "on-axis" are shown in FIGS. 1-15. These examples attempt to address the above-described technical challenges associated with the utilization of such a separate printing composition supply, such as redesign of the carriage and/or carriage latching assembly of a printing device.

As used herein the term "printing device" represents a printer, plotter, press and/or device that utilizes at least one printhead and printing composition (e.g., ink, toner, colorant, wax, dye, powder, latex, etc.) to create text, images, graphics, pictures and/or three-dimensional objects. A printing device may utilize any of the following marking technologies or a combination thereof: ink jet, dye sublimation, thermal transfer, 3D, laser, extrusion, off-set printing, or dot matrix. As used herein the terms "media" and "medium" are interchangeable and represent any type of paper or other printing medium (e.g., cloth, cardboard, canvas, transparency, substrate, etc.), having any type of finish on either or both sides (e.g., glossy, matte, plain, textured, etc.), in any size, shape, color, or form (e.g., sheet, roll (cut or uncut), folded, etc.) on which printing composition is placed, jetted, deposited, dropped, formed, or laid by at least one printhead.

As used herein, the terms "printhead" and "printheads" represent a mechanism, device or structure that implements any of the above-described marking technologies. A printhead or printheads can be a single structure, device or mechanism, or arranged in a module or array such as, for example, a print bar or page-wide array. As used herein, the terms "include", "includes", "including", "have", "has", "having" and variations thereof, mean the same as the terms "comprise", "comprises", and "comprising", or appropriate variations thereof.

An example of a mounting device 10 is shown in FIG. 1. As can be seen in FIG. 1, mounting device 10 interacts with a printhead assembly 12 having a plurality of printheads 14 that deposit printing composition on a medium (not shown), a plurality of printing composition tanks 16 that supply printing composition to printheads 14, and a manifold 18 to supply printing composition to printing composition tanks 16. In the example of printhead assembly 12 shown in FIG. 1, there are four different printheads 14 and printing composition tanks 16 for four different colors of printing composition (e.g., black, cyan, magenta, and yellow). It is to be understood, however, that other examples of printhead assembly 12 may include a greater or lesser number of printheads 14 and/or printing composition tanks 16. Additionally or alternatively, it is to be understood that other examples of print head assembly 12 may utilize a different color or colors of printing composition.

As can also be seen in FIG. 1, mounting device 10 includes an interconnect assembly 20 to supply printing composition to printhead assembly 12. Interconnect assembly 20 receives printing composition from a printing composition supply 22 and a tube assembly 24 coupled to printing composition supply 22 and interconnect assembly 20. Tube assembly 24 supplies printing composition from printing composition supply 22 to printhead assembly 12 via interconnect assembly 20 and manifold 18. Mounting device 10 also includes a carriage 26 to hold printhead assembly 12.

Figure 2:
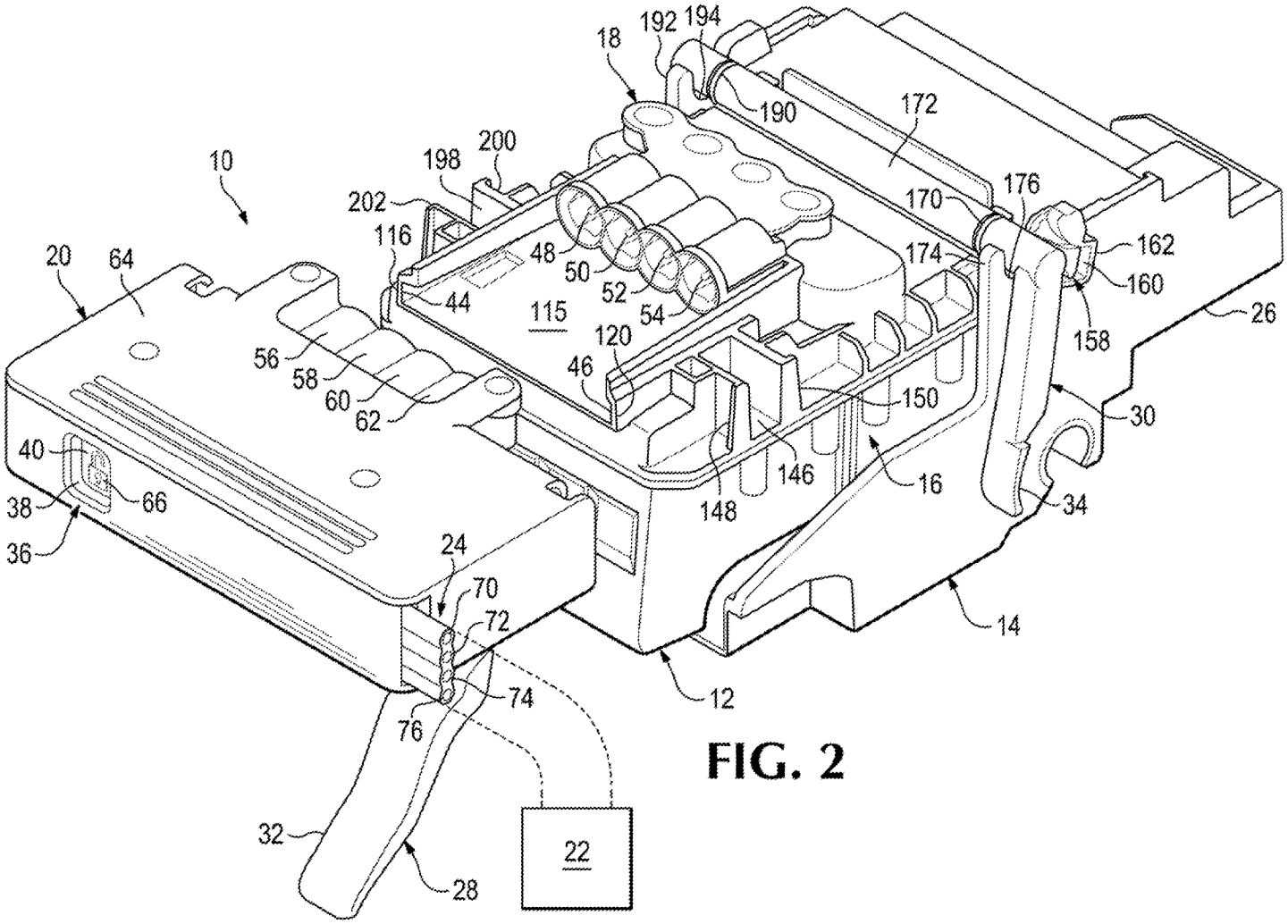
FIG. 2 is another isometric view of the example of the mounting device.

As can additionally be seen in FIG. 1, mounting device 10 also includes a first latching assembly 28 having an engaged condition to lock or connect interconnect assembly 20 to manifold 18 of printhead assembly 12 and a disengaged condition to unlock or disconnect interconnect assembly 20 from manifold 18 of printhead assembly 12, as shown, for example, in FIG. 2. Referring again to FIG. 1, mounting device 10 also includes a second latching assembly 30 having an engaged condition to lock printhead assembly 12 to carriage 26 and a disengaged condition to unlock printhead assembly 12 carriage 26, as shown, for example, in FIG. 9.

Mounting device 10 is designed so that second latching assembly 30 cannot be moved from the engaged condition to the disengaged condition unless first latching assembly 28 is in the disengaged condition. This helps to insure that interconnect assembly 20 disengaged from printhead assembly 12 before printhead assembly 12 is removed from carriage 26. As can be seen in FIG. 1, this is accomplished by virtue of first manually actuable lever 32 of first latching assembly 28 being in a closed position which blocks movement of second manually actuable lever 34 of second latching assembly 30 from the closed position to the open position shown, for example, in FIG. 9.

As can further be seen in FIG. 1, interconnect assembly 20 includes an indicator assembly 36 that has a window 38 through which an indicator 40 is displayed to provide visible information regarding the condition or interconnect assembly 20. As can be seen, indicator 40 is displaying a closed lock 42 which corresponds to the engaged condition of first latching assembly 28.

An example of mounting device 10 with first latching assembly 28 thereof in a disengaged condition is shown in FIG. 2. As can be seen in FIG. 2, first manually actuable lever 32 has been moved from the closed position shown in FIG. 1 to an open position to unlock interconnect assembly 20 from printhead assembly 12. Interconnect assembly 20 has been manually removed from slots 44 and 46 of printhead assembly 12 which has removed needles 48, 50, 52, and 54 from septums (not shown in FIG. 2) within shrouds 56, 58, 60, and 62 of cover 64 which allows second manually actuable lever 34 to be moved from the closed position shown in FIG. 2 to the open position shown, for example, in FIG. 9, as discussed more fully below. As can also be seen in FIG. 2, indicator 40 is displaying an open lock 66 which corresponds to the disengaged condition of first latching assembly 28.

Figure 3:
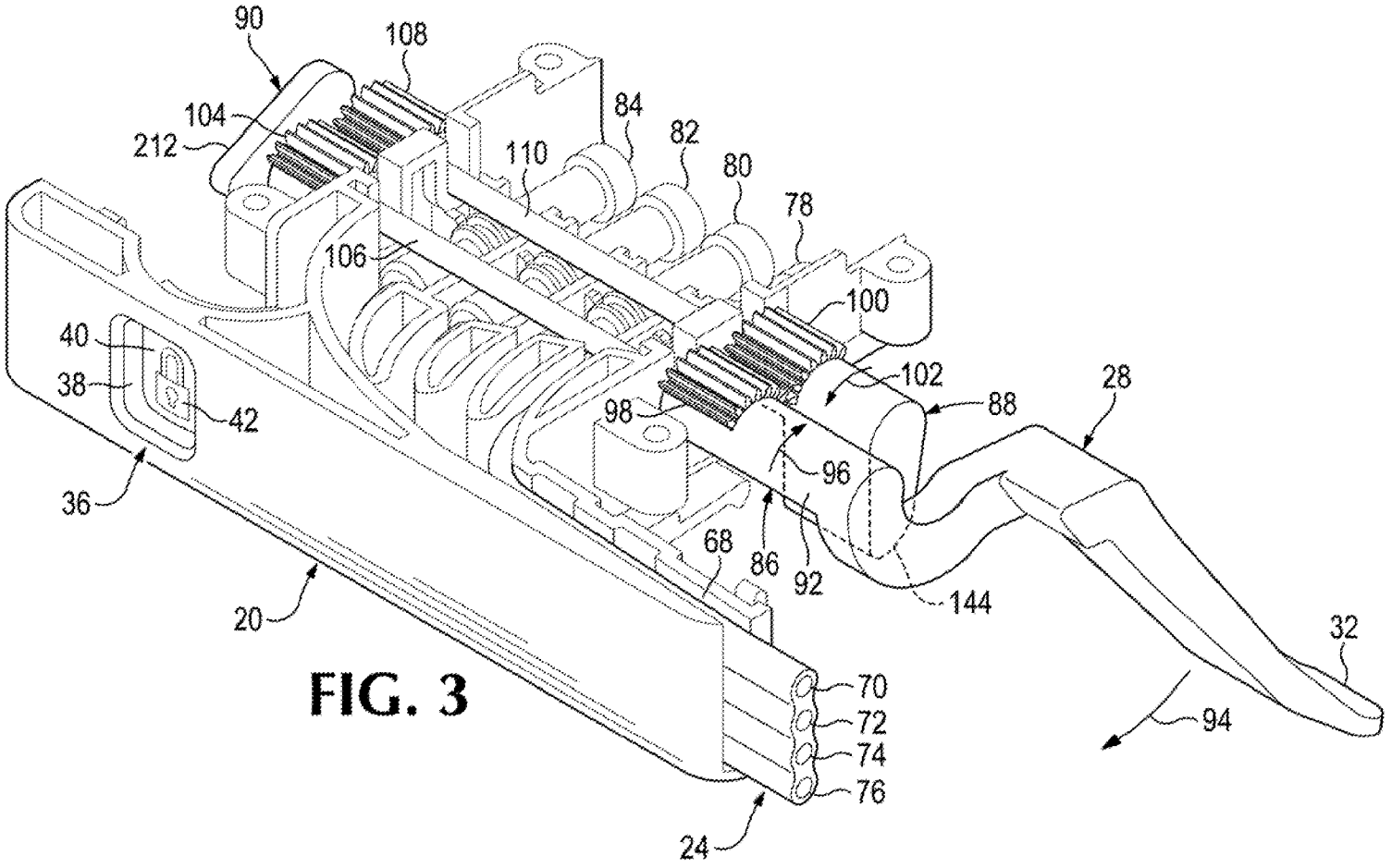
FIG. 3 is an isometric view of an example of the interconnect assembly of mounting device of FIGS. 1 and 2.

An isometric view of an example of interconnect assembly 20 of mounting device 10 is shown in FIG. 3. As can be seen in FIG. 3, cover 64 or interconnect assembly 20 has been removed to illustrate that interconnect assembly 20 includes a channel or groove 68 in which tube assembly 24 is disposed. Channel or groove 68 routes tubes 70, 72, 74, and 76 of tube assembly 24 to respective septum 78, 80, 82, and 84. Each of tubes 70, 72, 74, and 76 and respective septums 78, 80, 82, and 84 convey a different color of printing composition that is provided by printing composition supply 22 to one of the printing composition tanks 16 via respective needles 54, 52, 50, and 48 and manifold 18, as shown, for example, in FIG. 4.

As can also be seen in FIG. 3, first latching assembly 28 includes a lever mechanism 86 operatively coupled to a cam mechanism 88 and a cam mechanism 90. Lever mechanism 86 includes a shaft 92 attached to first manually actuable lever 32 so that movement of first manually actuable lever 32 of first latching assembly 28 in the direction of arrow 94 causes shall 92 to rotate clockwise in the direction of arrow 96. A gear 98 is formed on or attached to shaft 92 that meshes with a gear 100 coupled to cam mechanism 88 so that rotation of shaft 92 in the direction of arrow 96 causes gear 98 to rotate in the same direction indicated by arrow 96. Rotation of gear 98 in the direction of arrow 96 in turn causes gear 100 to rotate in the opposite direction indicated by arrow 102 which rotates cam mechanism 88 in a first direction, as discussed more fully below.

As can additionally be seen in FIG. 3, lever mechanism 86 also includes a gear 104 coupled to shaft 92 via shall 106 so that rotation of shaft 92 in the direction of arrow 96 causes gear 104 to rotate in the same direction indicated by arrow 96. Lever mechanism 86 additionally includes a gear 108 coupled cam mechanism 90 and also to gear 100 via shaft 110 so that gear 108 rotates in the same direction as gear 100 (i.e., the direction indicated by arrow 102) and cam mechanism 90 rotates in the same first direction as cam mechanism 88, as discussed more fully below.

Figure 4:
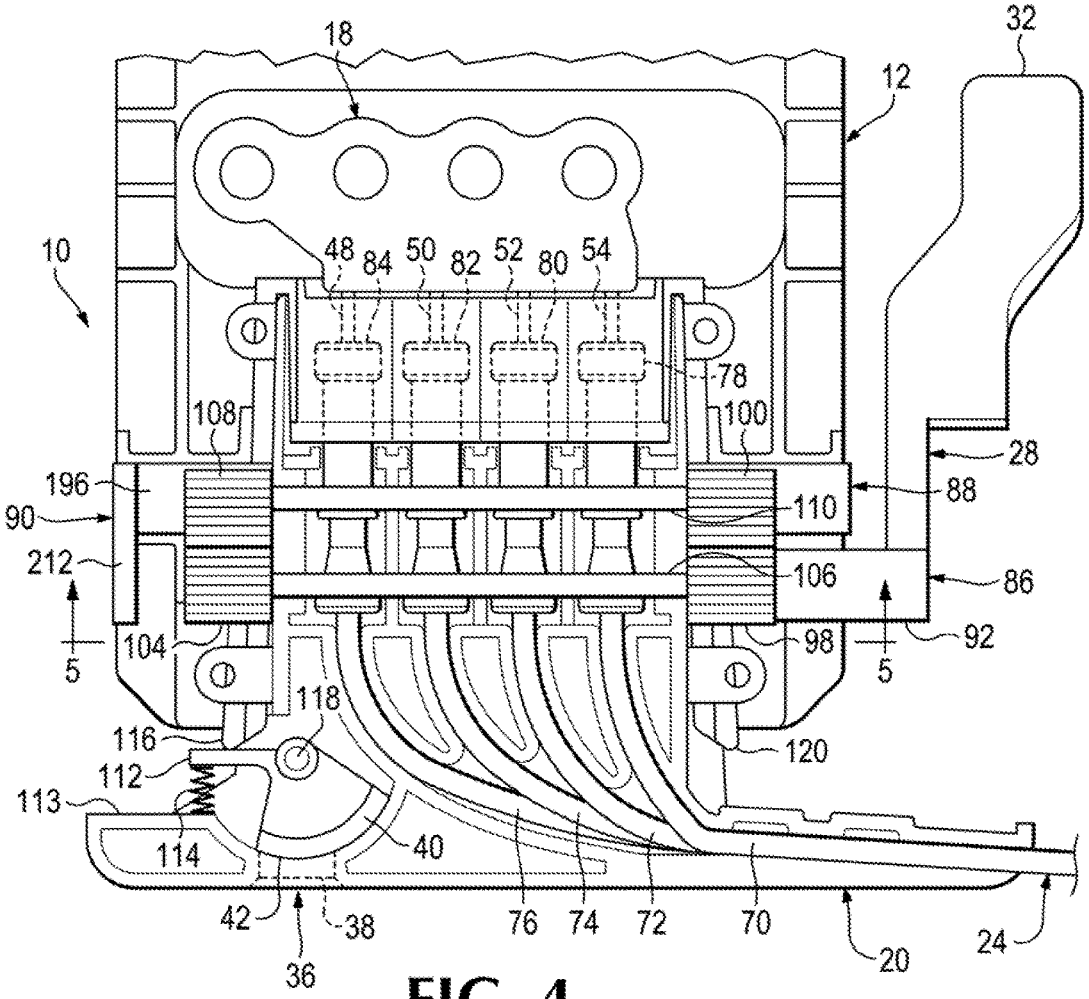
FIG. 4 is a top view of an example of a portion of the mounting device of FIG. 1.

A top view of an example of a portion of mounting device 10 is shown in FIG. 4. As can be seen in FIG. 4, first latching assembly 28 of interconnect assembly 20 is in the engaged condition to lock interconnect assembly 20 to manifold 18 and cover 64 of interconnect assembly 20 has been removed. Needles 54, 52, 50, and 48 of manifold 18 are disposed in respective septums 78, 80, 82, and 84 of interconnect assembly 20 so that printing composition in tubes 70, 72, 74, and 76 of tube assembly 24 may be supplied by printing composition supply 22 (not shown in FIG. 3) to printhead assembly 12. As can also be seen in FIG. 4, indicator 40 of indicator assembly 36 includes an arm 112 and a biasing member 114 positioned between arm 112 and wall 113 of interconnect assembly 20. Arm 112 is adjacent wall 116 and biasing member 114 compressed. Indicator 40 is displaying a closed lock 42 which corresponds to the engaged condition of first latching assembly 28. As can additionally be seen, indicator assembly 36 includes a shall 118 about which indicator 40 rotates, as discussed more fully below in connection with FIG. 6.

Figure 5:
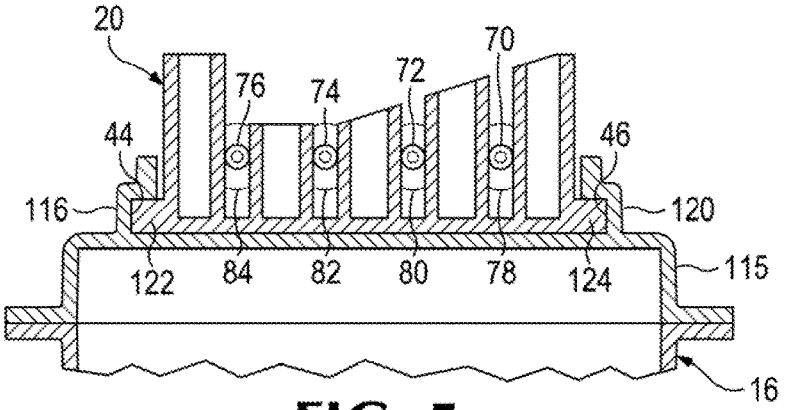
FIG. 5 is an example of a view of a portion of the mounting device of FIG. 4 taken along line 5-5.

An example of a view of a portion of mounting device 10 taken along line 5-5 of FIG. 4 is shown in FIG. 5. As can be seen in FIG. 5, cover 115 of printhead assembly 12 includes upstanding walls 116 and 120 that define respective slots 44 and 46. As can also be seen in FIG. 5, interconnect assembly 20 includes rails 122 and 124 that are disposed in respective slots 44 and 46 to help secure interconnect assembly 20 to cover 115. Slots 44 and 46 and rails 122 and 124 also help to guide interconnect assembly 20 along cover 115 toward and away from manifold 18 as interconnect assembly 20 translates between the engaged condition shown, for example, in FIG. 1 and the disengaged condition shown, for example, in FIG. 2.

Figure 6:
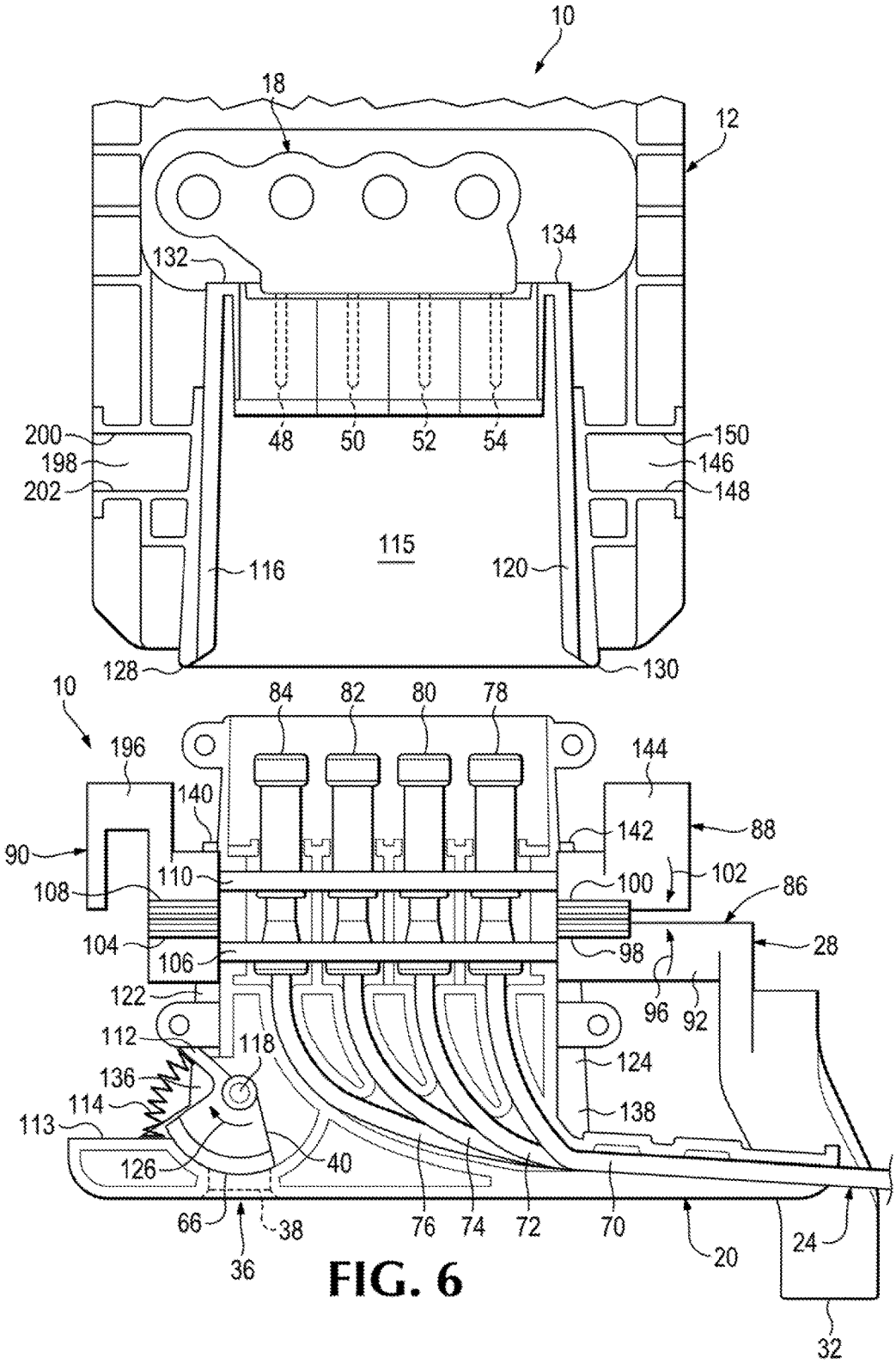
FIG. 6 is a top view of an example of a portion of the mounting device of FIG. 2.

A top view of another example of a portion of mounting device 10 is shown FIG. 6. As can be seen in FIG. 6, first latching assembly 28 of interconnect assembly 20 is in the disengaged condition to unlock interconnect assembly 20 from manifold 18 and cover 64 of interconnect assembly 20 has been removed. Needles 48, 50, 52, and 54 of manifold 18 are removed from respective septums 84, 82, 80, and 78 of interconnect assembly 20 so that printing composition in tubes 70, 72, 74, and 76 of tube assembly 24 is not supplied by printing composition supply 22 (not shown in FIG. 6) to printhead assembly 12. As ran also be seen in FIG. 6, arm 112 of indicator assembly 36 is no longer adjacent wall 116 so that biasing member 114 is no longer compressed. This allows biasing member 114 to expand which causes indicator 40 of indicator assembly 36 to rotate about shaft 118 in the direction of arrow 126. This results in indicator 40 displaying an open lock 66 which corresponds to the disengaged condition of first latching assembly 28.

As can additionally be seen in FIG. 6, walls 116 and 120 of cover 115 of printhead assembly 12 taper inwardly toward manifold 18. That is, walls 116 and 120 are farther apart at respective ends 128 and 130 and closer together at respective ends 132 and 134. This also results in an inward tapering of slots 44 and 46 defined by respective walls 116 and 120. Similarly, rails 122 and 124 of interconnect assembly 20 taper inwardly toward septums 78, 80, 82, and 84. That is rails 122 and 124 are further apart at respective ends 136 and 138 and closer together at respective ends 140 and 142. This tapering of slots 44 and 46 helps facilitate the initial insertion of rails 122 and 124 within slots 44 and 46 at respective ends 128 and 130.

As can further be seen in FIG. 6, lever mechanism 86 of first latching assembly 28 has been moved to the open position from the closed position shown in FIG. 5. This has caused shall 92 and gears 98 and 104 to rotate in the direction of arrow 96 to the position shown in FIG. 6. Additionally, rotation of gears 98 and 104 in the direction of arrow 96 has caused gears 100 and 108 to rotate in the direction of arrow 102 to the position shown in FIG. 6. Rotation of gears 100 and 108 in the direction of arrow 102 in turn has caused cam mechanisms 88 and 90 to both rotate in a first direction from the position shown in FIG. 5 to the position shown in FIG. 6.

Figure 7:
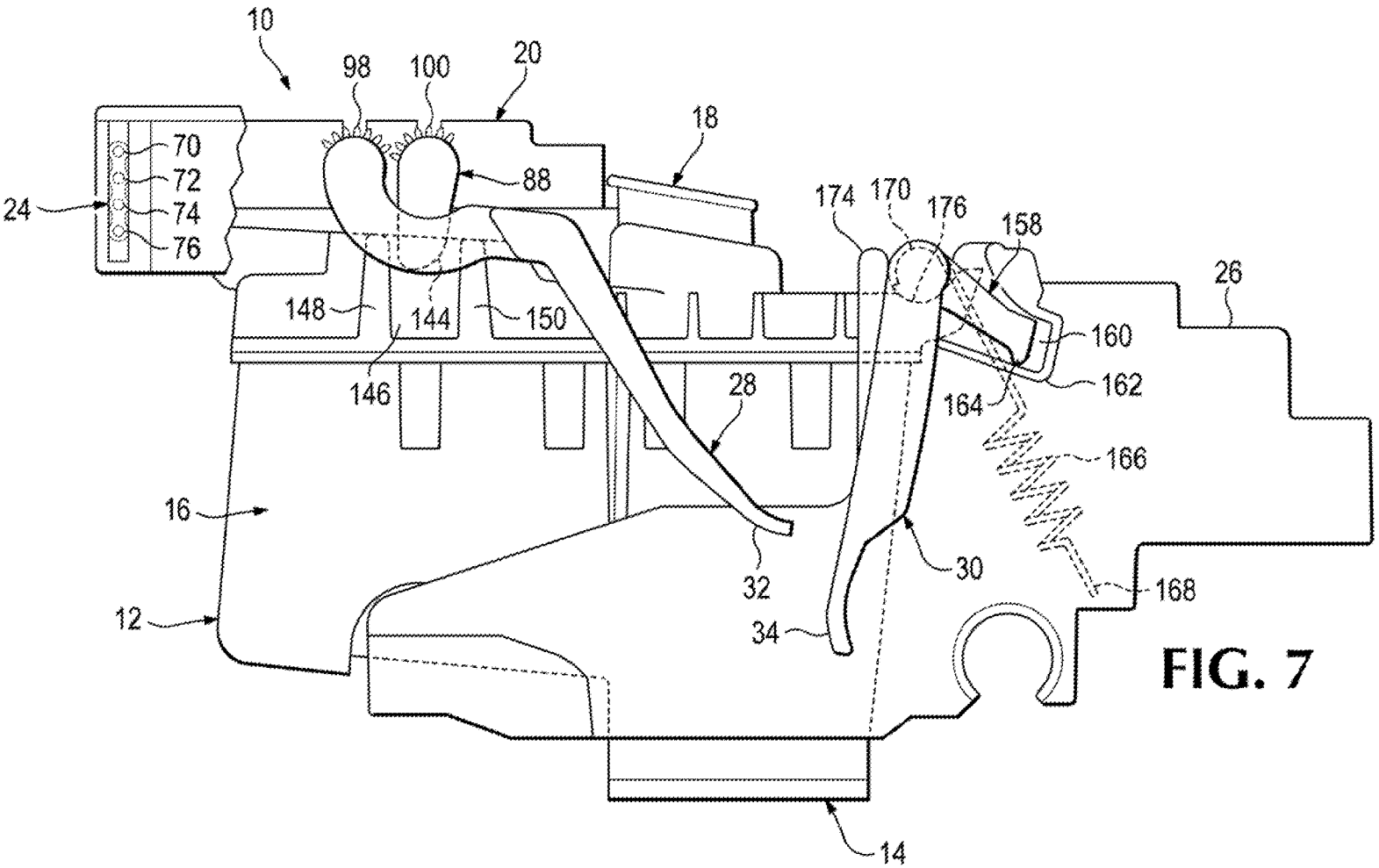
FIG. 7 is a side view of an example of a mounting device.

A side view of mounting device 10 is shown in FIG. 7. As can be seen in FIG. 7, first latching assembly 28 is in an engaged condition to lock interconnect assembly 20 to manifold 18 of printhead assembly 12. This engaged condition of first latching assembly 28 includes first manually actuable lever 32 being in a first or closed position shown in FIG. 7. As can also be seen in FIG. 7, second latching assembly 30 is in an engaged condition to lock printhead assembly 12 to carriage 26. This egged condition of second latching assembly 30 includes second manually actuable lever 34 being in a first or closed position as shown in FIG. 7.

Mounting device 10 is designed so that second latching assembly 30 cannot be moved from the engaged condition to the disengaged condition unless first latching assembly is in the disengaged condition. This helps to insure that interconnect assembly 20 is disengaged from printhead assembly 12 before printhead assembly 12 is removed from carriage 26. As can be seen in FIG. 1, this is accomplished by virtue of fast manually actuable lever 32 of first latching assembly 28 being in a closed position which blocks movement of second mutually actuable lever 34 of second latching assembly 30 from the closed position to the open position shown, for example, in FIG. 9.

As can further be seen in FIG. 7, cam mechanism 88 of interconnect assembly 20 includes a lobe 144 that is disposed in recess 146 defined by protrusions 148 and 150 of printhead assembly 12. Positioning of lobe 144 in recess 146 helps to lock interconnect assembly 20 to manifold 18 of printhead assembly 12.

Figure 8:
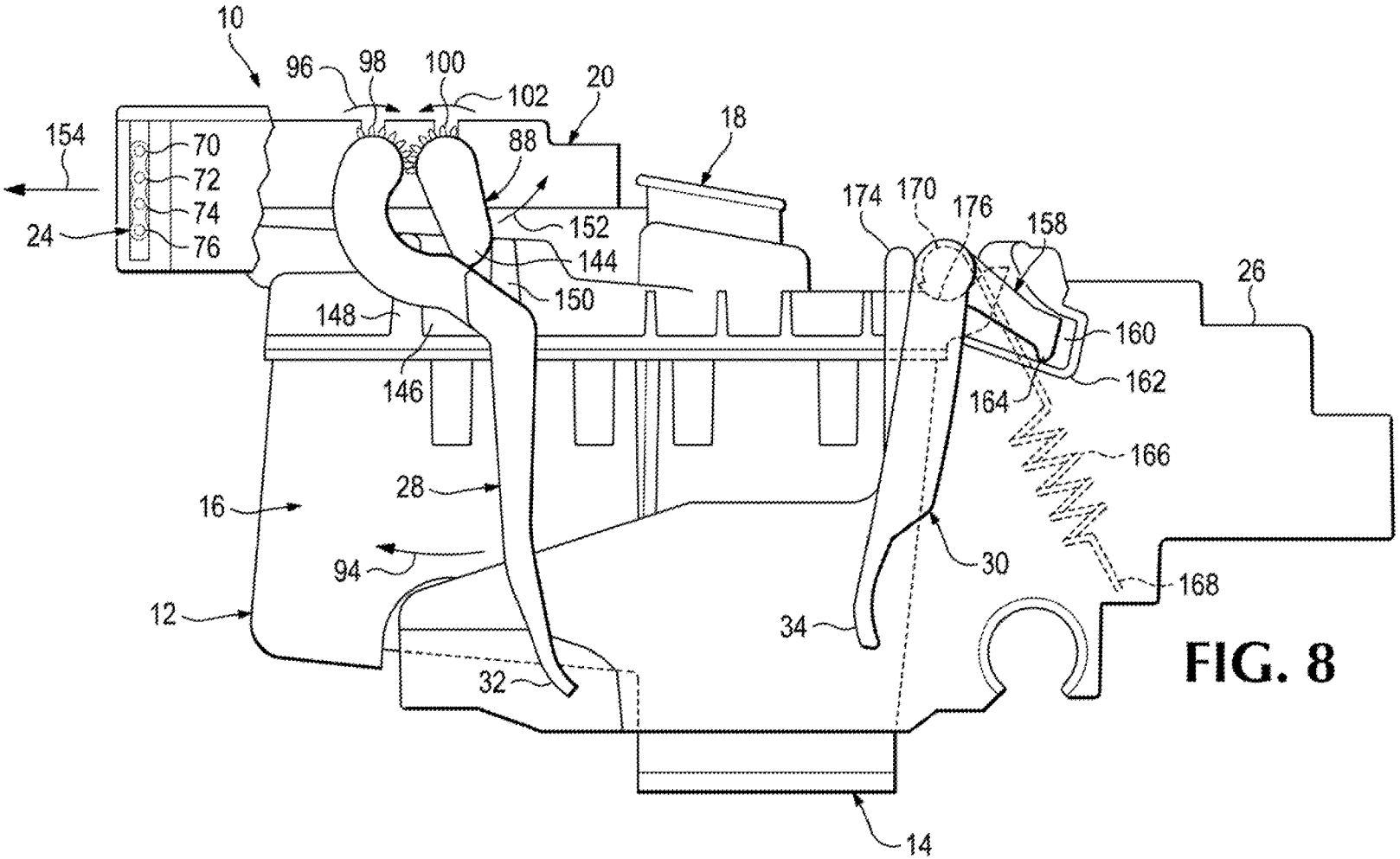
FIG. 8 is another side view of the example of a mounting device of FIG. 7.

Another side view of mounting device 10 is shown in FIG. 8. As can be seen in FIG. 8, first latching assembly 28 is in a disengaged condition to unlock interconnect assembly 20 from manifold 18 of printhead assembly 12. This disengaged condition of first latching assembly 28 includes first manually actuable lever 32 being moved in the direction of arrow 94 from the first or closed position shown in FIG. 7 to the second or open position shown in FIG. 8. As discussed above, movement of first manually actuable lever 32 in the direction of arrow 94 causes shall 92 (not shown in FIG. 8) of lever mechanism 86 (also not shown in FIG. 8) to rotate clockwise in the direction of arrow 96 which also rotates gear 98 in the direction of arrow 96, as shown in FIG. 8. Rotation of gear 98 in the direction of arrow 96 causes gear 100 to rotate in the direction of arrow 102 which rotates cam mechanism 88 in a first direction indicated by arrow 152. Rotation of cam mechanism 88 in first direction 152 causes lobe 144 of cam mechanism 88 to press against protrusion 150 which causes interconnect assembly 20 to translate away from manifold 18 in the direction indicated by arrow 154.

Figure 9:
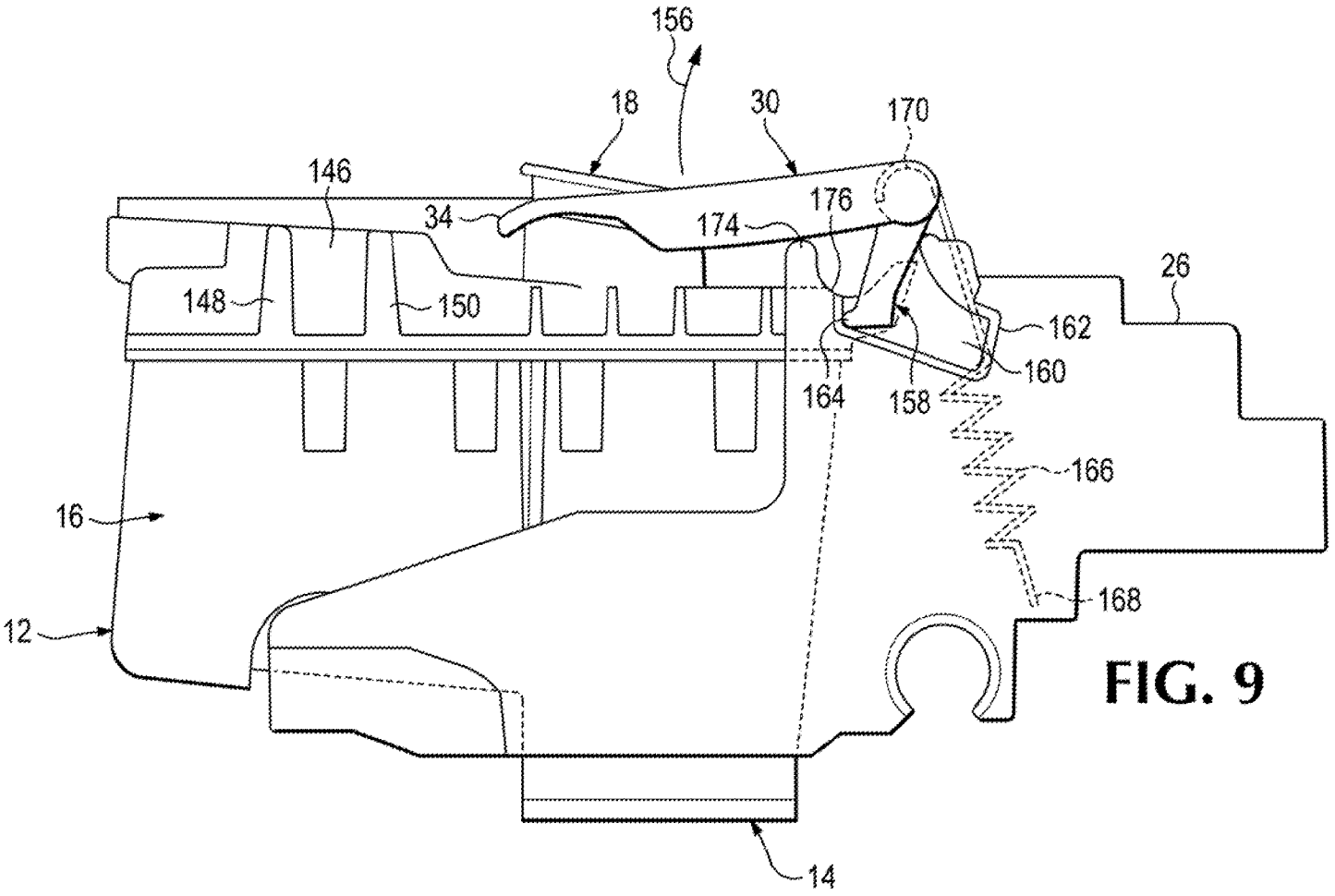
FIG. 9 is an additional side view of the example of the mounting device of FIG. 7.

An additional side view of mounting device 10 is shown in FIG. 9. As can be seen in FIG. 9, interconnect assembly 20 has been removed from printhead assembly 12 and second latching assembly 30 is in a disengaged condition to unlock printhead assembly 12 from carriage 26. This disengaged condition of second latching assembly 30 includes second manually actuable lever 34 being moved in the direction of arrow 156 from the first or closed position shown, for example, in FIG. 8 to the second or open position shown in FIG. 9.

As can also be seen in FIG. 9, second latching assembly 30 includes a stand-off member 158 that translates within a slot 160 defined by wall 162 of carriage 26 from the position shown, for example, in FIG. 8 to the position shown in FIG. 9 during movement of second manually actuable lever 34 in the direction of arrow 156. Stand-off member 158 includes a foot or protrusion 164 that abuts against wall 162 as shown in FIG. 9 to help limit movement of stand-off member 158 and retain it within slot 160. Second latching assembly 30 also includes a biasing member 166 attached on one end 168 to carriage 26 and on another end 170 to shaft 172 (see, e.g., FIG. 1) of second latching assembly 30 to also help retain stand-off member 158 within slot 160. As can be seen, for example, by comparing FIGS. 8 and 9, biasing member 166 expands during movement of second manually actuable lever 34 in the direction of arrow 156 from the first or closed position shown in FIG. 8 to the second or open position shown in FIG. 9.

Figure 10:
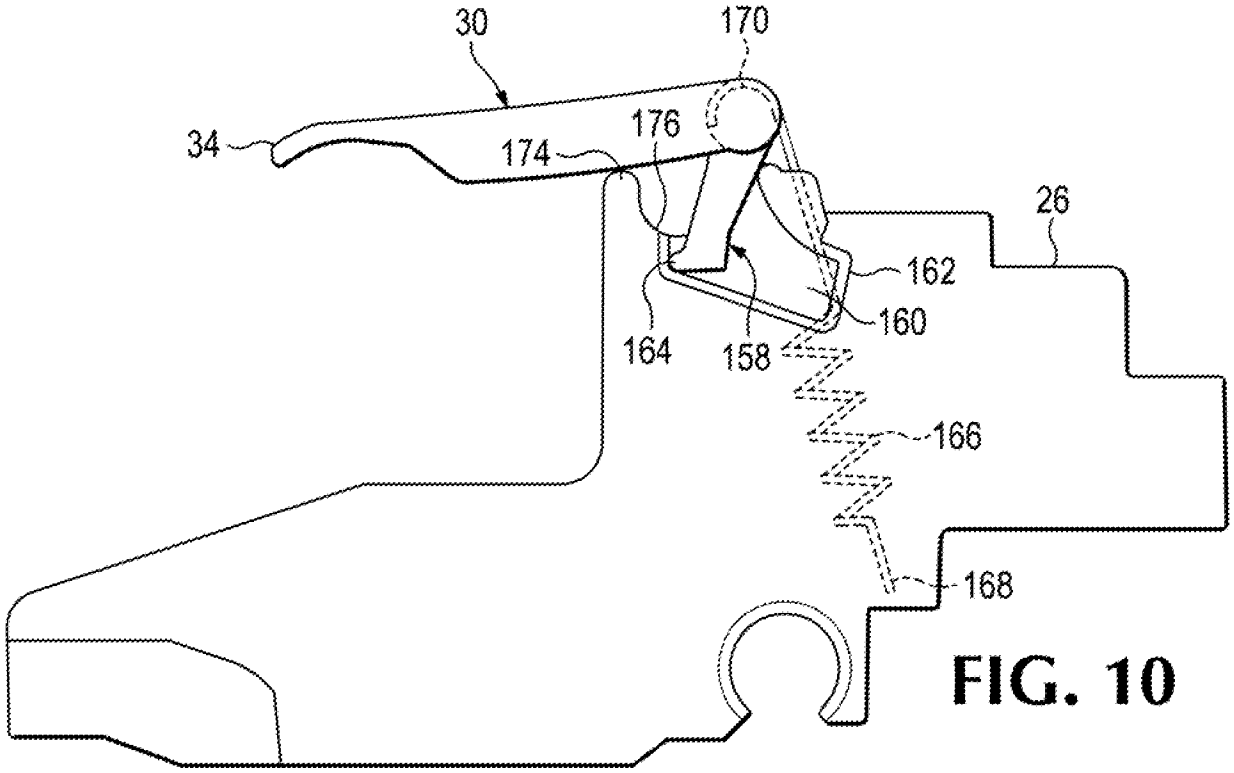
FIG. 10 is a further side view of the example of the mounting device of FIG. 7.

As can additionally be seen in FIG. 9, carriage 26 includes, a hook 174 having a recess 176 from which second latching assembly 30 is removed in the disengaged condition to unlock printhead assembly 12 from carriage 26. Once printhead assembly 12 is unlocked from carriage 26 by removing second latching assembly 30 from recess 176 of hook 174, printhead assembly 12 may be removed from carriage 26 as shown in FIG. 10. As can be seen, for example, in FIG. 8, second latching assembly 30 is disposed in recess 176 of hook 174 when second latching assembly 30 in the engaged condition which locks printhead assembly 12 to carriage 26.

Figure 11:
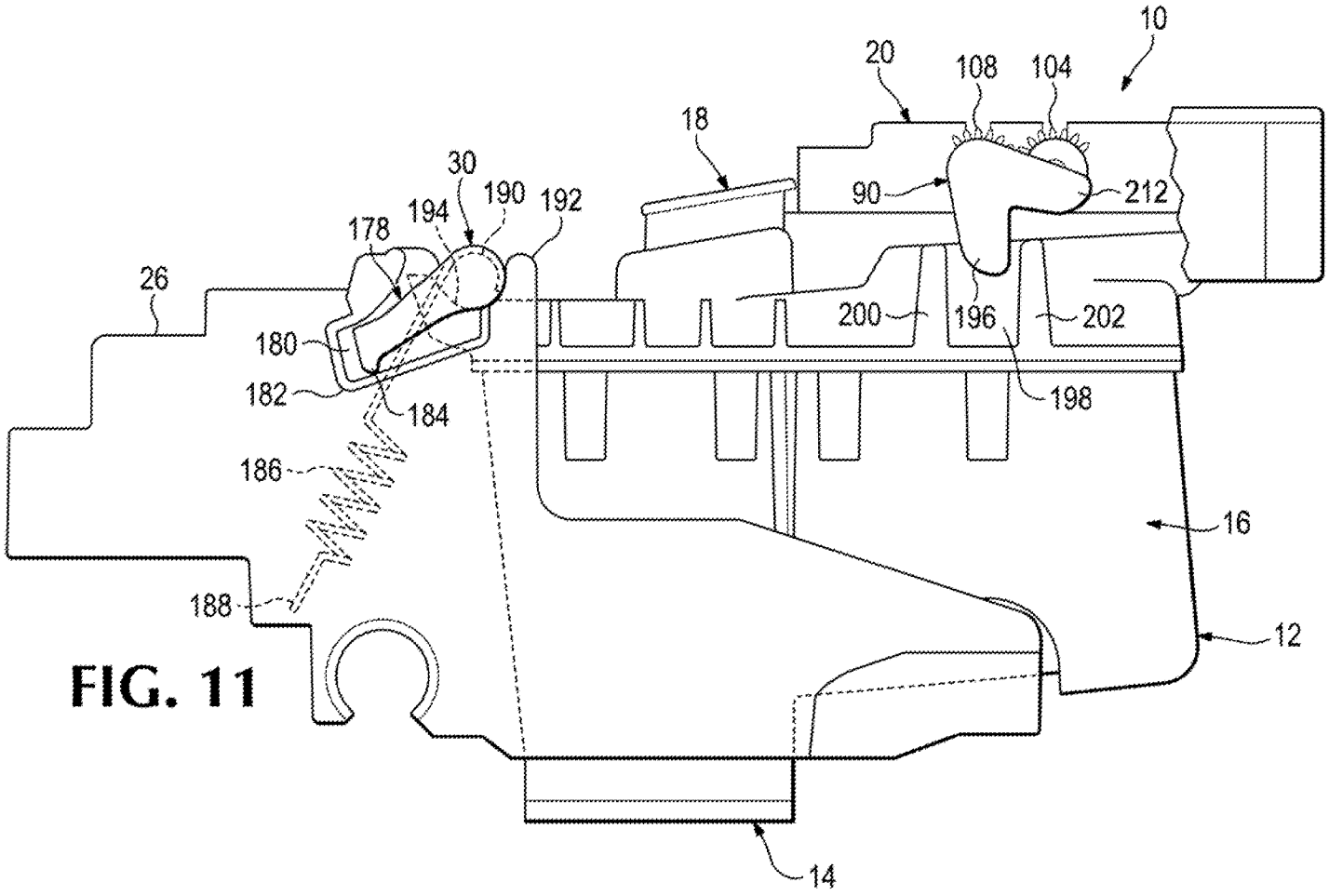
FIG. 11 is an opposite side view of an example of a mounting device.

An opposite side view of an example of mounting device 10 shown in FIG. 11. As can be seen in FIG. 11, second latching assembly 30 includes an additional stand-off member 178 that translates within a slot 180 defined by wall 182 of carriage 26 in the same was as stand-off member 158. Stand-off member 178 also includes a foot or protrusion 184 that abuts against wall 182 to help limit movement of stand-off member 178 and retain it within slot 180. Second latching assembly 30 also includes a biasing member 186 attached on one end 188 to carriage 26 and on another end 190 to shaft 172 (see, e.g., FIG. 1) of second latching assembly 30 that also helps to retain stand-off member 178 within slot 180.

As can also be seen in FIG. 11, carriage 26 includes a hook 192 having a recess 194 in which second latching assembly 30 is disposed when second latching assembly 30 is in the engaged condition which locks printhead assembly 12 to carriage 26. Although not shown, it is to be understood that second latching assembly 30 is removed from recess 194 of hook 192 in the disengaged condition to unlock printhead assembly 12 from carriage 26 in the same manner as shown, for example, in FIG. 9 with respect to removal of latching assembly 30 from recess 176 of hook 174.

As can further be seen in FIG. 11, cam mechanism 90 of interconnect assembly 20 includes a lobe 196 that is disposed in recess 198 defined by protrusions 200 and 202 of print bead assembly 12. Positioning of lobe 196 in recess 198 helps to lock interconnect assembly 20 to manifold 18 of printhead assembly 12.

Figure 12:
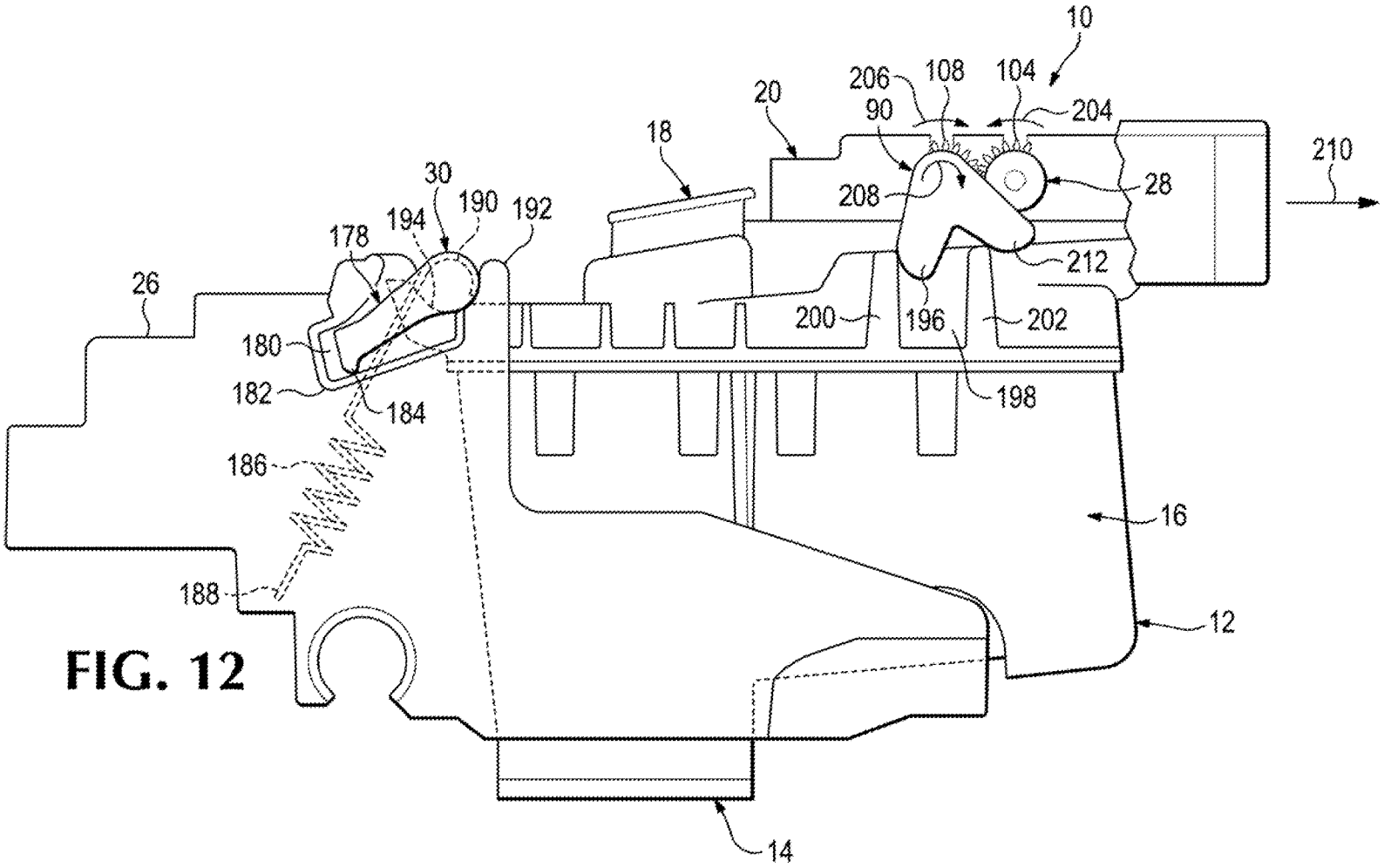
FIG. 12 is another opposite side view of the example of the mounting device of FIG. 11.

Another opposite side view of mounting device 10 is shown in FIG. 12. In FIG. 12, first latching assembly 28 is in a disengaged condition to unlock interconnect assembly 20 from manifold 18 of printhead assembly 12. As discussed above, this disengaged condition of first latching assembly 28 includes first manually actuable lever 32 being moved in the direction of arrow 94 from the first or closed position shown in FIG. 7 to the second or open position shown in FIG. 8. As also discussed above, movement of first manually actuable lever 32 in the direction of arrow 94 causes shall 92 (not shown in FIG. 12) of lever mechanism 86 (also not shown in FIG. 12) to rotate in the directions of arrow 96 which also rotates gear 98 in the direction of 96 as shown in FIG. 8. Rotation of gear 98 in turn rotates gear 104 in the direction of arrow 204 as shown in FIG. 12 because of the connection of gear 98 to gear 104 via shaft 106 (see FIG. 3). Rotation of gear 98 in the direction of arrow 96 also causes gear 100 to rotate in the direction of arrow 102 (see FIG. 3) which rotates gear 108 in the direction of arrow 206 (see FIG. 12) because of the connection of gear 100 to gear 108 via shall 110 (see FIG. 3). Gear 108 is also rotated the direction of arrow 206 by virtue of the meshing of gear 108 with gear 104 which is rotating in the opposite direction of arrow 204.

Rotation of gear 108 in the direction of arrow 206 causes cam mechanism 90 to rotate a first direction indicated by arrow 208. Rotation of cam mechanism 90 in first direction 208 causes lobe 196 of cam mechanism 90 to press against protrusion 200 which causes interconnect assembly 20 to translate away from manifold 18 in the direction indicated by arrow 210. As can be seen in FIG. 12, rotation of cam mechanism 90 in first direction 208 also causes an additional second lobe 212 of cam mechanism 90 to press against protrusion 202 which also causes interconnect assembly 20 to translate away from manifold in the direction indicated by arrow 210.

Figure 13:
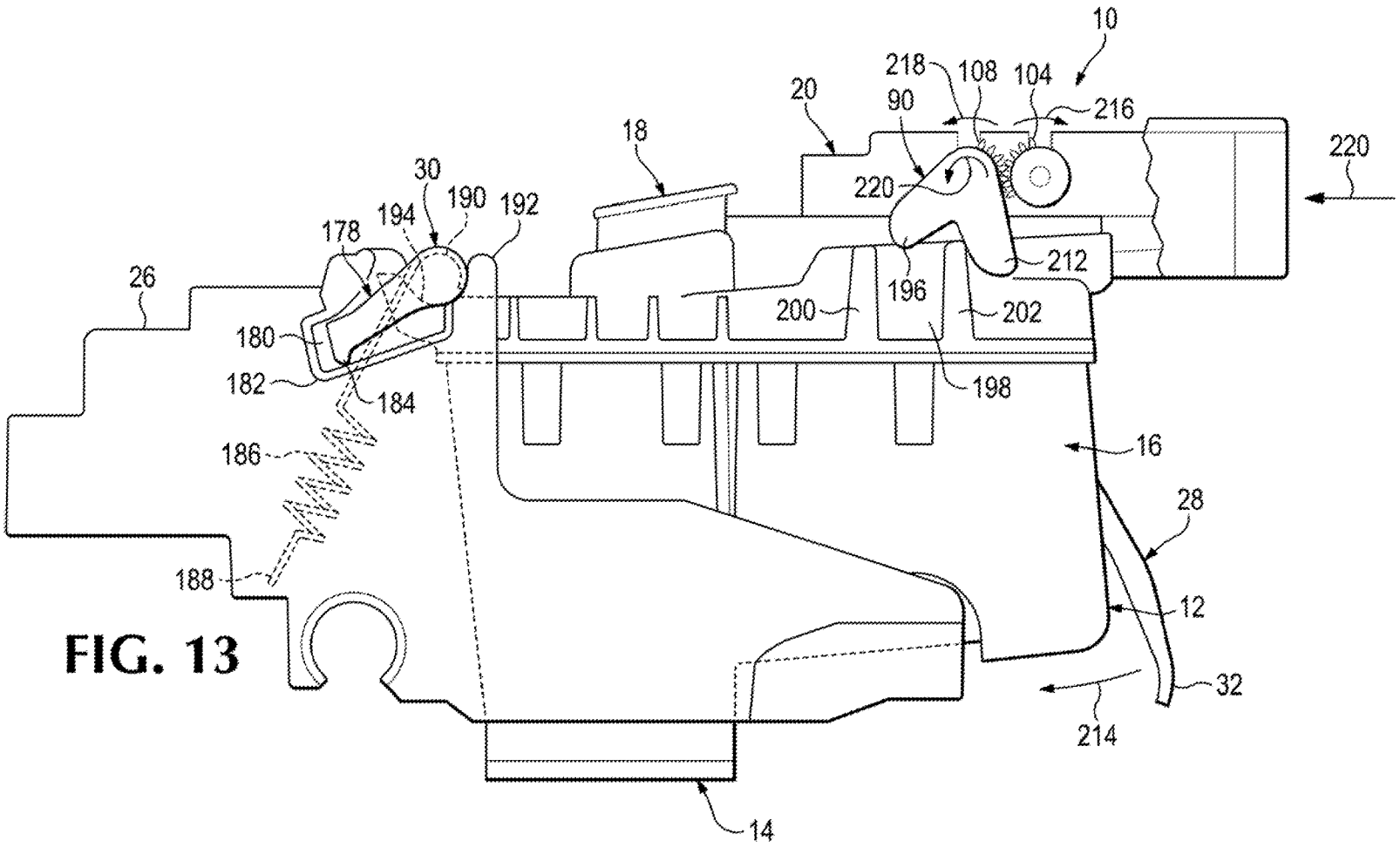
FIG. 13 is an additional opposite side view of the example of the mounting device of FIG. 11.

An additional opposite side view of mounting device 10 is shown in FIG. 13. In FIG. 13, first latching assembly 28 is being changed from the disengaged condition to the engaged condition to lock interconnect assembly 20 to manifold 18 of printhead assembly 12. This change of first latching assembly 28 from the disengaged condition to the engaged condition includes first manually actuable lever 32 being moved in the direction of arrow 214 from the second or open position shown in FIG. 13 to the first or closed position shown, for example, in FIG. 1. Movement of first manually actuable lever 32 in the direction of arrow 214 causes shaft 92 (not shown in FIG. 13) of lever mechanism 86 (also not shown in FIG. 13) to rotate in the opposite direction of arrow 96 which also rotates gear 98 in the opposite direction of arrow 96, shown, for example, FIG. 3. This rotation of gear 98 in turn rotates gear 104 the direction of arrow 216 shown in FIG. 13 because of the connection of gear 98 to gear 104 via shaft 106 (see FIG. 3). Rotation of gear 98 in the opposite direction of arrow 96 also causes gear 100 to rotate in the opposite direction of arrow 102 which rotates gear 108 in the direction of arrow 218 (see FIG. 13) because of the connection of gear 100 to gear 108 via shall 110 (see FIG. 3). Gear 108 is also rotated in the direction of arrow 218 by virtue of the meshing of gear 108 with gear 104 which is rotating in the opposite direction of arrow 216.

Rotation of gear 108 in the direction of arrow 218 causes cam mechanism 90 to rotate in a second direction indicated by arrow 220. Rotation of cam mechanism 90 in second direction 220 causes lobe 212 of cam mechanism 90 to push against protrusion 202 which causes interconnect assembly 20 to translate toward manifold 18 in the direction indicated by arrow 220, eventually returning interconnect assembly 20 and cam mechanism 90 to the position shown in FIG. 11. In a similar manner, movement of first manually actuable lever 32 in the direction of arrow 214 shown in FIG. 13, causes cam mechanism 88 to rotate in a second direction opposite of first direction 152 shown in FIG. 8, eventually returning interconnect assembly 20, first latching assembly 28, and cam mechanism 88 to the position shown in FIG. 7.

Figure 14:
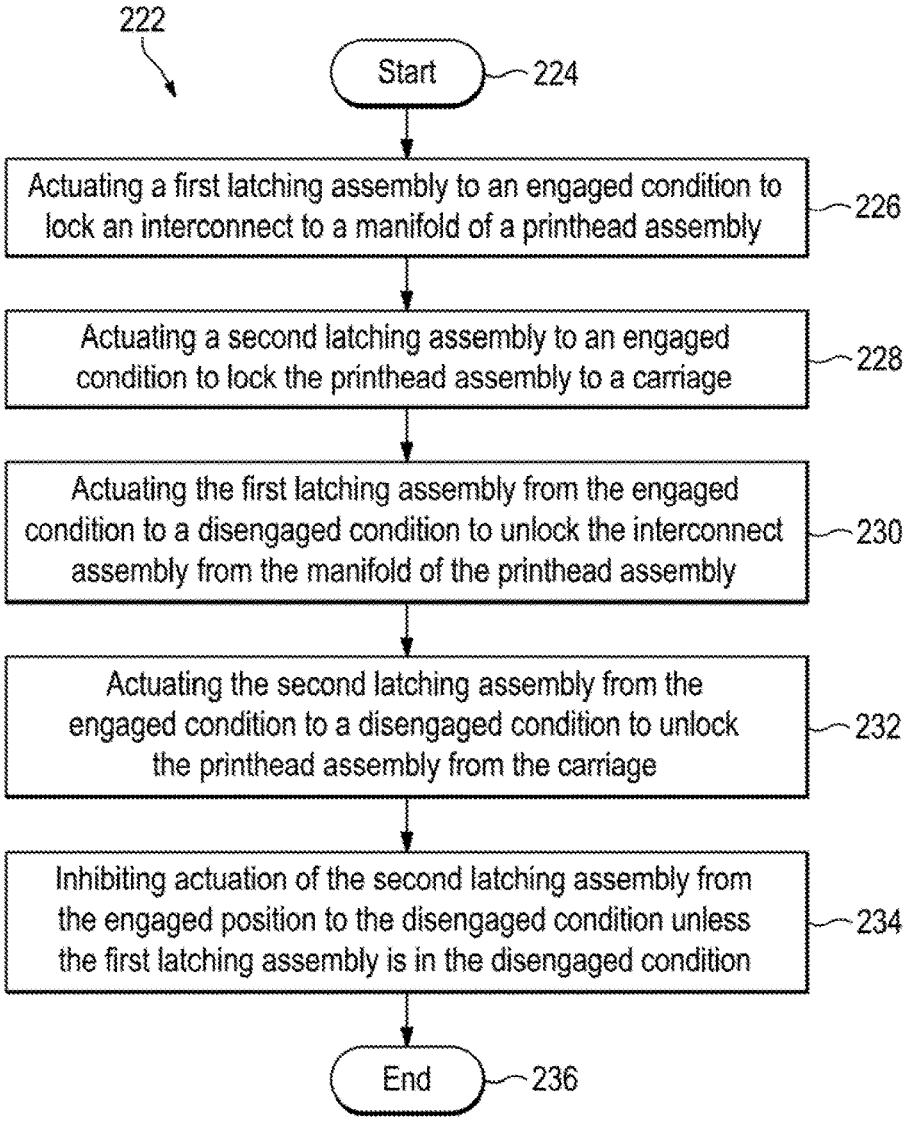
FIG. 14 is an example of a method to use in a mounting device.

An example of a method 222 to use in a mounting device is shown in FIG. 14. As can be seen in FIG. 14, method 222 starts 224 by actuating a first latching assembly to an engaged condition to lock an interconnect to a manifold of a printhead assembly, as indicated by block 226, and actuating a second latching assembly to an engaged condition to lock the printhead assembly to a carriage, as indicated by block 228. Method 222 continues by actuating the first latching assembly from the engaged condition to a disengaged condition to unlock the interconnect assembly from the manifold of the printhead assembly, as indicated by block 230, and actuating the second latching assembly from the engaged condition to a disengaged condition to unlock the printhead assembly from the carriage, as indicated by block 232. Method 222 continues by inhibiting actuation of the second latching assembly from the engaged position to the disengaged condition unless the first latching assembly in the disengaged condition as indicated by block 234. Method 222 may then end 236.

Figure 15:
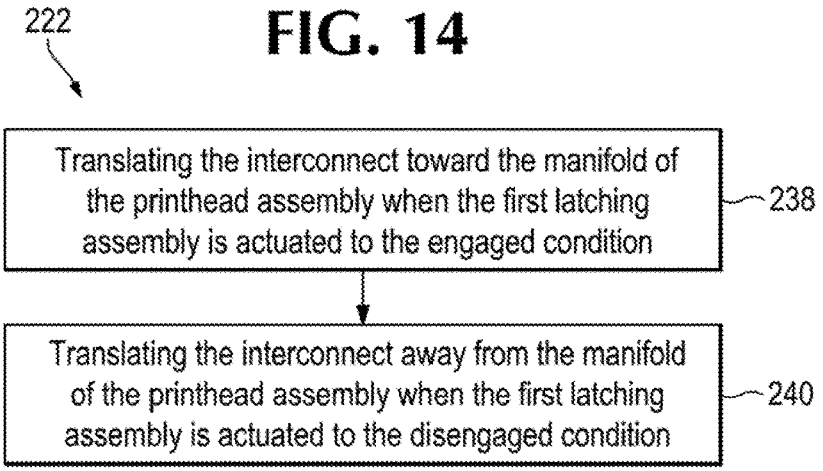
FIG. 15 is an example of additional elements of the method to use in a mounting device of FIG. 14.

An example of additional elements of method 222 is shown in FIG. 15. As can be seen in FIG. 15 method 222 may include translating the interconnect toward the manifold of the printhead assembly when the first latching assembly is actuated to the engaged condition, as indicated by block 238, and translating the interconnect away from the manifold of the printhead assembly when the first latching assembly is actuated to the disengaged condition, as indicated by block 240.

Although several drawings have been described and illustrated in detail, it is to be understood that the same are intended by way of illustration and example. These examples are not intended to be exhaustive or to be limited to the precise form disclosed. Modifications and variations may well be apparent. For example, although not shown, it is to be understood that cam mechanism 88 and/or cam mechanism 90 may utilize a biasing member or biasing members to assist with movement in the first and/or second direction(s). As another example, although not shown, it is to be understood that first latching assembly 28 could use a single axle without gears 98, 100, 104, and 108 to rotate cam mechanisms 88 and 90.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A mounting device, comprising:

a carriage to hold a printhead assembly;

an interconnect assembly to supply printing composition to the printhead assembly;

a first latching assembly including an engaged condition to lock the interconnect assembly to a manifold of the printhead assembly and a disengaged condition to unlock the interconnect assembly from the manifold of the printhead assembly; and a second latching assembly including an engaged condition to lock the printhead assembly to the carriage and a disengaged condition to unlock the printhead assembly from the carriage, wherein the second latching assembly cannot be moved from the engaged condition to the disengaged condition unless the first latching assembly is in the disengaged condition.

2. The mounting device of claim 1, wherein the first latching assembly includes a first manually actuable lever movable between a closed position to lock the interconnect assembly to the printhead assembly and an open position to unlock the interconnect assembly from printhead assembly.

3. The mounting device of claim 2, wherein the second latching assembly includes a second manually actuable lever movable between a closed position to lock the printhead assembly to the carriage and an open position to unlock the printhead assembly from the carriage, and further wherein the second manually actuable lever is prevented from moving from the closed position to the open position by the first manually actuable lever when the first manually actuable lever is in the closed position.

4. The mounting device of claim 2, wherein the first latching assembly additionally includes a cam mechanism to which the first manually actuable lever is operatively coupled, and further wherein movement of the first manually actuable lever from the closed position to the open position rotates the cam mechanism in a first direction which causes the interconnect assembly to translate away from the manifold.

5. The mounting device of claim 4, wherein movement of the first manually actuable lever from the open position to the closed position rotates the cam mechanism in a second direction which causes the interconnect assembly to translate toward the manifold.

6. The mounting device of claim 1, further comprising:

a printing composition supply; and a tube assembly coupled to the printing composition supply and the interconnect assembly to supply printing composition from the printing composition supply to the printhead assembly via the interconnect assembly and the manifold.

7. A mounting device, comprising:

a printhead assembly including a printhead to deposit printing composition on a medium, a printing composition tank to supply printing composition to the printhead, and a manifold to supply printing composition to the printing composition tank;

an interconnect assembly to supply printing composition to the printhead assembly; and a latching assembly including a lever mechanism operatively coupled to a cam mechanism, the cam mechanism including a lobe to lock the interconnect assembly to the printhead, the lever mechanism including a first position to lock the interconnect assembly to the manifold and a second position to unlock the interconnect assembly from the manifold, wherein movement of the lever mechanism from the first position to the second position rotates the cam mechanism in a first direction which causes the interconnect assembly to translate away from the manifold.

8. The mounting device of claim 7, wherein the printhead assembly includes a protrusion against which the lobe presses during rotation of the cam mechanism in the first direction which causes the interconnect assembly to translate away from the manifold.

9. The mounting device of claim 7, wherein movement of the lever mechanism from the second position to the first position rotates the cam mechanism in a second direction which causes the interconnect assembly to translate toward the manifold.

10. The mounting device of claim 9, wherein the printhead assembly includes a protrusion against which the lobe pushes during rotation of the cam mechanism in the second direction which causes the interconnect assembly to translate toward the manifold.

11. The mounting device of claim 7, further comprising:

a carriage to hold the printhead assembly; and a second latching assembly including a second lever mechanism having a first position to lock the printhead assembly to the carriage and a second position to unlock the printhead assembly from the carriage.

12. The mounting device of claim 11, wherein the second lever mechanism cannot be moved from the first position to the second position unless the interconnect assembly is disconnected from the manifold.

13. The mounting device of claim 7, further comprising:

a printing composition supply; and a tube assembly coupled to the printing composition supply and the interconnect assembly to supply printing composition from the printing composition supply to the printhead assembly via the interconnect assembly and the manifold.

14. A method to use in a mounting device, comprising:

actuating a first latching assembly to an engaged condition to lock an interconnect assembly to a manifold of a printhead assembly;

actuating a second latching assembly to an engaged condition to lock the printhead assembly to a carriage;

actuating the first latching assembly from the engaged condition to a disengaged condition to unlock the interconnect assembly from the manifold of the printhead assembly;

actuating the second latching assembly from the engaged condition to a disengaged condition to unlock the printhead assembly from the carriage; and inhibiting actuation of the second latching assembly from the engaged condition to the disengaged condition unless the first latching assembly is in the disengaged condition.

15. The method of claim 14, further comprising:

translating the interconnect assembly toward the manifold of the printhead assembly when the first latching assembly is actuated to the engaged condition; and translating the interconnect assembly away from the manifold of the printhead assembly when the first latching assembly is actuated to the disengaged condition.

* * * * *